US007552956B1

(12) United States Patent
Holloway

(10) Patent No.: US 7,552,956 B1
(45) Date of Patent: Jun. 30, 2009

(54) ITEM COLLECTING, STORING AND/OR TRANSPORTING DEVICE

(76) Inventor: Carl Lanford Holloway, 724 Hampton Hill Rd., Columbia, SC (US) 29209

( * ) Notice: Subject to any disclaimer, the term of this patent is extended or adjusted under 35 U.S.C. 154(b) by 0 days.

(21) Appl. No.: 11/837,947

(22) Filed: Aug. 13, 2007

Related U.S. Application Data

(60) Provisional application No. 60/822,146, filed on Aug. 11, 2006.

(51) Int. Cl.
*B65F 5/00* (2006.01)

(52) U.S. Cl. ..... 294/1.1; 294/152; 383/4

(58) Field of Classification Search ..... 294/1.3, 294/1.5, 152, 1.1; 5/627; 280/19; 56/329; 383/4

See application file for complete search history.

(56) References Cited

U.S. PATENT DOCUMENTS 530,599 A * 12/1894 Oheimb ..... 190/1
2,242,311 A * 5/1941 Lucey ..... 5/627
3,336,060 A * 8/1967 Bradford ..... 403/108
3,481,519 A * 12/1969 Snetselaar ..... 294/152
3,797,051 A * 3/1974 Evans ..... 5/627
4,434,829 A * 3/1984 Barnard ..... 383/34
4,561,480 A * 12/1985 Underwood et al. ..... 383/34
5,265,289 A * 11/1993 Swiger et al. ..... 5/111
5,451,107 A * 9/1995 Ricker ..... 383/10
5,660,402 A * 8/1997 Jones et al. ..... 280/19
5,775,495 A * 7/1998 Lang ..... 206/315.1
6,276,698 B1 * 8/2001 Calandra ..... 280/19

* cited by examiner

*Primary Examiner*—Dean J Kramer
(74) *Attorney, Agent, or Firm*—Lawrence A. Aaronson, P.C.

(57) ABSTRACT

A folding apparatus is provided for collecting, storing, and/or transporting various items, such as fallen leaves. According to various embodiments, the apparatus includes a tough tarp with a folding rigid outer frame and interlocking handles. The folding apparatus is adapted to allow a user to collect leaves and/or other items onto the tarp, and subsequent to folding or closing the apparatus, to store and/or transport these items.

17 Claims, 4 Drawing Sheets

ITEM COLLECTING, STORING AND/OR TRANSPORTING DEVICE

CROSS REFERENCE TO RELATED APPLICATIONS

The present application claims priority to U.S. Provisional Application No. 60/822,146, filed Aug. 11, 2006, the contents of which are expressly incorporated herein by reference in its entirety.

TECHNICAL FIELD

This disclosure relates to collecting, storing and/or transporting items.

BACKGROUND

Proper maintenance of the curtilage, or yard, of a dwelling or business is often a time and labor intensive task. For example, in locations that experience relatively cold climates, the collection and removal of leaves that have fallen from trees, and the removal of other refuse, may constitute a significant task.

Yard tarps, which may be made from, for example, water resistant canvas coated with plastic or latex, are often used in connection with the collection of fallen leaves. Conventional yard tarps, however, are problematic for many reasons. For example, when raking leaves onto conventional yard tarps, the rake tines often catch the side of the tarp, thus pulling at least a portion of the tarp onto itself. When this occurs, the leaves are no longer raked entirely onto the tarp, but rather a significant portion is raked onto the ground where the tarp formally was situated. Additional problems also arise in connection with the use of conventional tarps while transporting gathered leaves. For example, when trying to take the leaf filled tarp out to the street for pickup, leaves frequently fall out of various sides as the user attempts to awkwardly hold together all four corners of the tarp while it is being moved. Furthermore, the materials currently used to construct conventional yard tarps are generally intended for covering wood piles, boats, cars and the like (e.g., for protection from inclement weather only), and are not designed to stand up to the type of prolonged friction that may occur while dragging the tarp, filled with leaves or other refuse, to the street for pickup.

Therefore, what is needed is an apparatus for collecting, storing, and/or transporting various items, such as fallen leaves, without the aforementioned and other problems commonly associated with conventional yard tarps.

SUMMARY

Disclosed herein are folding apparatus and a method for making a folding apparatus. In one implementation, the apparatus has a four-sided frame where the sides are selectively detachable from one another. The apparatus also has a substantially rectangular tarp with at least one sleeve extending along each side of the tarp. The sleeves are adapted to receive one of the sides of the frame by retaining at least a portion of the side of the frame. Two of the sides of the frame that are not adjacent to each other each have a pivot joint that permits each of those sides to fold. The apparatus has an open configuration where the sides of the frames with pivot joints are extended in a substantially straight line. The apparatus also has a closed configuration where the sides of the frame with pivot joints are folded to create an enclosure in the attached tarp.

In another embodiment, the apparatus has a four-sided frame. The apparatus also has a substantially rectangular tarp with at least one connection along each side of the tarp adapted to connect to one of the sides of the frame. The connections of each side of the tarp connect a corresponding side of the frame. Two of the sides of the frame that are not adjacent to each other each have a pivot joint that permits each of those sides to fold. The apparatus has an open configuration where the sides of the frames with pivot joints are extended in a substantially straight line. The apparatus also has a closed configuration where the sides of the frame with pivot joints are folded to create an enclosure in the attached tarp.

In another embodiment, at least one sleeve adapted to receive a side of a four-sided frame is attached along each side of a four-sided tarp. Two sides of the frame that are not adjacent are divided using a pivot joint that allows each side to be folded. Each side of the four-sided frame is inserted into a corresponding side of the tarp using the sleeves on the sides of the tarp. The sides of the frame are connected to form a four-sided frame.

Other features, objects, and advantages will be apparent to those skilled in the art from the following description and accompanying drawings.

DETAILED DESCRIPTION

A folding apparatus and method for making a folding apparatus is presented in detail with reference to the drawings, which are provided as illustrative examples so as to enable those skilled in the art to practice the apparatus and method described in the disclosure. Notably, the figures and examples below are not meant to limit the scope of the disclosure. Where certain elements can be partially or fully implemented using known components, only those portions of such known components that are necessary for an understanding of the present disclosure will be described, and detailed descriptions of other portions of such known components will be omitted so as not to obscure the disclosure. Further, the present disclosure encompasses present and future known equivalents to the components referred to herein by way of illustration.

Figure 1:
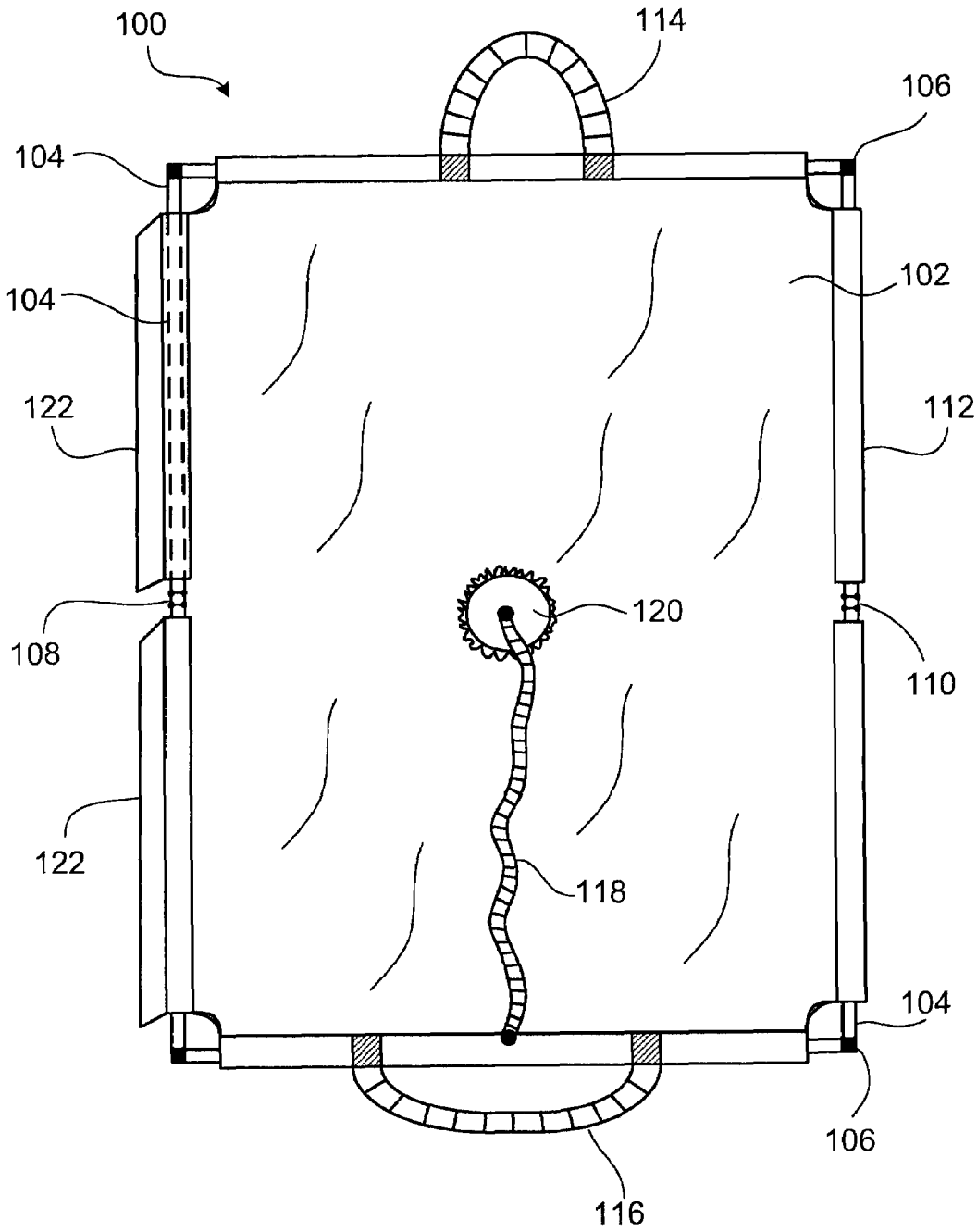
FIG. 1 illustrates a folding apparatus according to at least one embodiment of the present disclosure.

FIG. 1 provides a top view of a folding apparatus 100 in its open position according to one embodiment of the disclosure. As shown, folding apparatus 100 includes a tarp 102. According to various embodiments, tarp 102 is not taut around frame 104, which is discussed below, thus allowing tarp 102 to form a bag-like enclosure when apparatus 100 is in its closed, or folded, configuration. As explained in greater detail below with reference to FIG. 2, when in its closed position, folding apparatus 100 resembles an old-style change purse and serves to effectively contain gathered leaves or other items for storage and/or transportation (e.g., to the street for pickup or dumping).

Tarp 102 may be constructed, for example, using a tough canvas and/or one or more other materials that are strong enough to withstand frequent dragging over dirt or even a concrete surface. Such other materials may include nylon and sewn strands of cotton. Moreover, according to various embodiments, the material used to construct tarp 102 may be configured in a mesh configuration. In this case, according to various embodiments, the openings of the mesh tarp 102 are small enough to prevent small debris from escaping, but also large enough to permit moisture to escape. It will be understood that the disclosure is not limited to a particular type of material used to construct tarp 102, nor by the particular size of the openings of tarp 102 when a mesh configuration is employed. Moreover, it is contemplated that replacement tarps similar or identical to tarp 102 (which may have been purchased by a user together with the remainder of apparatus 100) may also be sold separately to users. Alternatively, for example, tarps of different materials and/or mesh characteristics may be available to users to satisfy different needs.

As referenced above, folding apparatus 100 also includes a four-sided, substantially rectangular, internal frame 104. According to various embodiments, frame 104 is constructed from a rigid, strong, but light material (e.g., titanium, aluminum, or a metal alloy). Moreover, frame 104 may be substantially flat, cylindrical or take any other suitable shape, and may be either hollow or solid.

As shown in FIG. 1, the four sides of frame 104 are connected at four corners 106, as explained in greater detail below with reference to FIG. 3. Moreover, frame 104 includes pivot joints 108 and 110, which are shown in greater detail in FIGS. 4A-4C and discussed below, at the respective midpoints of the two longer sides of frame 104.

When apparatus 100 is fully assembled, the four pieces or sides of frame 104 are situated through respective sleeves 112 of tarp 102 (as discussed in greater detail below with reference to FIG. 3). Moreover, according to various embodiments, such as the one shown in FIG. 1, the portions of tarp 102 near each of four corners 106 may be cut out (i.e., not present) to facilitate assembly of internal frame 104. Similarly, according to various embodiments, such as the one shown in FIG. 1, the portions of tarp 102 near pivot joints 108 and 110 may also be cut out. Persons versed in the art will appreciate that such cut outs, resulting in the exposure of corners 106 and pivot joints 108 and 110, may benefit a user such as by permitting easy application of oil for maintenance of apparatus 100.

According to various other embodiments (not shown), rather than simply being permanently absent, the four corners of tarp 102 and/or the portions of tarp 102 near pivot joints 108 and 110 may be selectively removable and attachable using, for example, VELCRO and/or ZIPPER attachment mechanisms. For example, the four corners of tarp 102 may be exposed to a user during assembly of apparatus 100 (whether or not they were exposed at the time of purchase of apparatus 100), and following successful assembly, the user may attach the corners for safety and/or aesthetic reasons. Alternatively, for example, when apparatus 100 is fully assembled prior to purchase by a user, these four corners of tarp 102 may be permanently affixed to (or manufactured as a part of) the remainder of tarp 102.

Apparatus 100 also includes handles 114 and 116 at the respective midpoints of the two shorter sides of frame 104. According to various embodiments, such as shown in FIG. 1, for increased ease of dragging, handles 114 and 116 may be configured such that they are approximately the same length, while the points of attachment of handle 114 to tarp 102 are closer together than the points of attachment of handle 116 to tarp 102. When in such a configuration, as is seen more clearly in FIG. 2 discussed below, handle 114 extends further away from tarp 102 than handle 116, and may optionally be used by itself to easily lift or drag apparatus 100.

Figure 2:
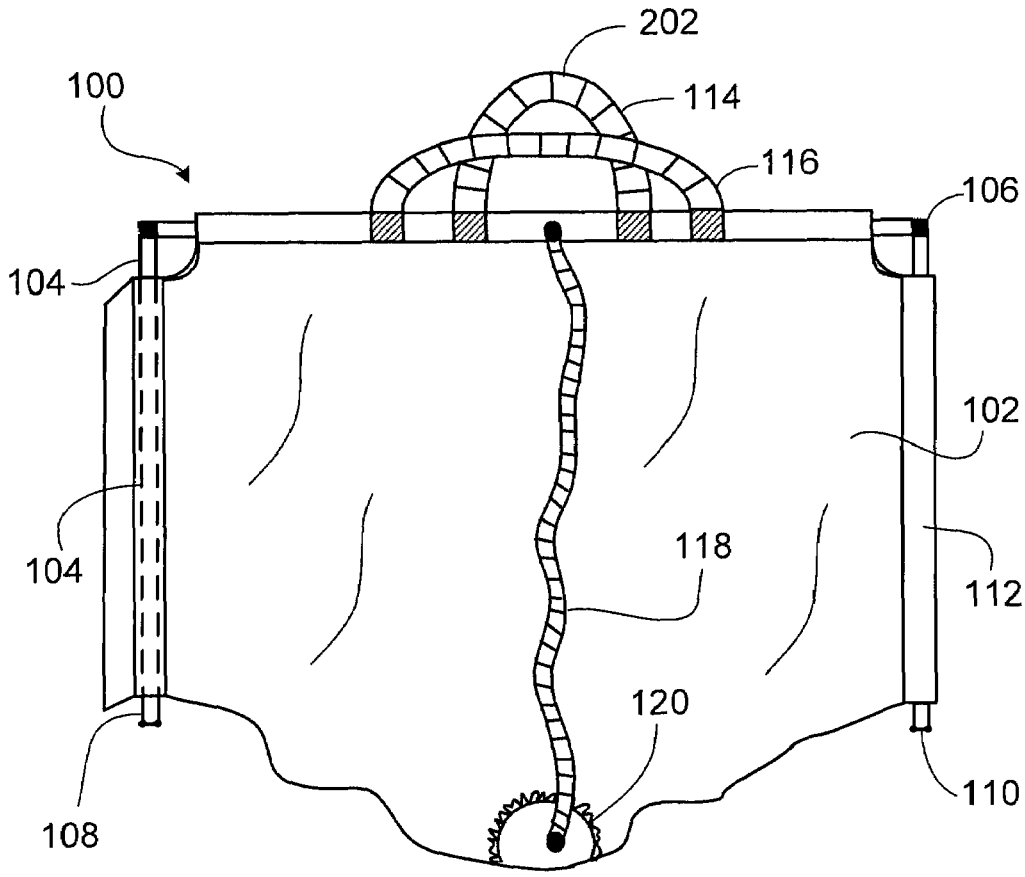
FIG. 2 illustrates the folding apparatus shown in FIG. 1 when the apparatus is in its closed, or folded, position.

As also shown in FIG. 1, apparatus 100 includes a rope 118 that is used to facilitate unloading of fallen leaves and/or other items from apparatus 100 after it has been closed as shown in FIG. 2. According to various embodiments, rope 118 is attached at one end to center portion 120 of tarp 102 and at the other end in close proximity to handle 114 or 116. For example, rope 118 may be sewn or stitched to these portions. Alternatively, rope 118 may be attached to these portions using glue or any other suitable method. After reaching the destination for unloading the items that have been collected in apparatus 100, and upon opening apparatus 100, a user may pull on rope 118 in order to cause the leaves and/or other collected items to fall out of the "bag" which has been formed by tarp 102 without the user having to kick or push the back side of tarp 102 for these items to fall out.

Although rope 118 is explained above as being attached at one end to a center portion 120 of tarp 102, it will be understood that the disclosure is not limited in this manner. Rather, for example, rope 118 may be attached at one end to some point in the interior of tarp 102 that is not in center portion 120 of tarp 102.

According to various embodiments, apparatus 100 may also include one or more optional edges 122 that are attached to frame 104 and/or an exterior portion of tarp 102. For example, in the embodiment shown in FIG. 1, a first edge 122 is attached to a first sleeve 112 frame 104, and a second edge 122 is attached to a second sleeve frame 104. These edges may also be attached to any exterior portion of frame 104 or sleeve 112, or through holes cut into sleeve 112 so that frame 104 is accessible. The edge 122 may be bolted, glued, or possess a snapping mechanism, etc., so that it can be securely or loosely attached to frame 104 or sleeve 112. According to various embodiments, edges 122 are made from a hard plastic or rubber. Alternatively, edges 122 may be made from another material that is able to maintain at least a semi-rigid structure. According to various embodiments, edges 122 are made from a relatively heavy material, such that they are more likely to retain contact with the ground when in use.

When apparatus 100 is in its open configuration, edges 122 may be used to facilitate the gathering of leaves or other items onto tarp 102 by completely preventing or at least reducing the portion of such items that are accidentally swept or raked underneath tarp 102. For example, when attached to an apparatus 100 that is in its open configuration, edges 122 may serve as a slight "ramp" off the ground and onto tarp 102 such that items swept or raked in the direction of edges 122 are forced over edges 122 and onto tarp 102 (rather than underneath tarp 102).

According to various embodiments, it is contemplated that edges 122 discussed above and shown in FIG. 1 be selectively detachable from apparatus 100. Moreover, for example, edges 122 may be attached in such a manner that they are able to pivot and be folded onto tarp 102 and remain partially or completely inside of the perimeter of frame 104 when apparatus 100 is in its closed configuration (as shown in FIG. 2). Additionally, although two edges 122 are shown in FIG. 1 and described above, it will be understood that the disclosure is not limited in this manner. For example, only a single edge 122, or more than two edges 122, may be used. In addition, it is not required that an edge 122 be of the same or similar length as a sleeve 112. For example, although not shown, an edge that is approximately half of the length of a particular sleeve 112 may be attached to that sleeve 112.

FIG. 2 illustrates the folding apparatus 100 of FIG. 1 when in its closed position. Apparatus 100 may be closed by a user by simply pulling together the two shorter sides of frame 104 (e.g., using handles 114 and 116). According to various embodiments, once handles 114 and 116 are brought near each other, they may be interlocked to prevent apparatus 100 from accidentally opening up, thereby preventing accidental spillage of items being contained within tarp 102. In this case, apparatus 100 may be opened by releasing one of handles 114 and 116. Alternate methods of keeping apparatus 100 closed are also contemplated. For example, according to various embodiments, the two shorter sides of frame 104 may be magnetized such that they are magnetically attracted to each other once they are brought to within a certain distance of each other. In this case, once apparatus 100 is closed, a sufficient force may be applied by a user to separate the two shorter sides of frame 104 in order to open apparatus 100. Moreover, it is also contemplated that one or more mechanisms be employed to facilitate the opening of folding apparatus 100 from its closed configuration. For example, one or more springs may be attached to frame 104 such that, upon an initial exertion of force by a user to open apparatus 100 from its closed configuration, the one or more springs serve to assist in the opening of apparatus 100.

As mentioned above and can be clearly seen from FIG. 2, handle 114 extends further away from tarp 102 than handle 116, and when apparatus 100 is closed, handle 114 may be used to easily drag apparatus 100. In particular, as shown, handle 114 may be passed through handle 116 when apparatus 100 is closed, such that a user need only deal with one handle as opposed to two or more. Moreover, according to various embodiments, this single, primary use, handle will be large enough to accommodate both of the user's hands.

According to various embodiments, handle 114 may include a hand piece 202 to make handling of apparatus 100 more comfortable for a user. For example, hand piece 202 may be made from a soft rubber. Moreover, hand piece 202 may be sufficiently inflexible such that handle 114 does not bend around and cause excess pressure on certain parts of a user's hand when apparatus 100 is being lifted or dragged by the user.

Although handles 114 and 116 are explained above as being situated at respective midpoints of the two shorter sides of frame 104, it will be understood that the disclosure is not limited in this manner. That is, handles 114 and 116 may be situated at points other than the midpoints of the two shorter sides of frame 104.

Figure 3:
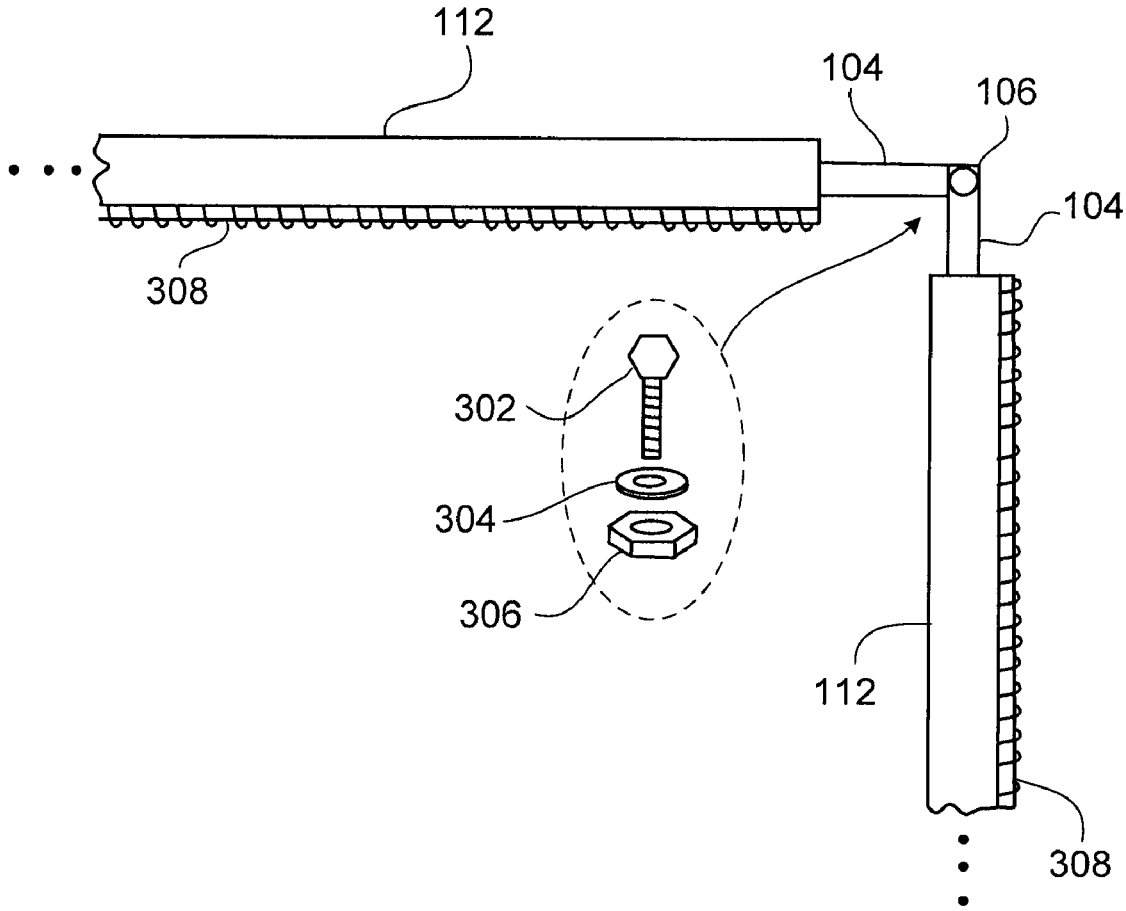
FIG. 3 provides a more detailed view of one connection location of the apparatus shown in FIG. 1 according to various embodiments of the present disclosure.

FIG. 3 provides a more detailed view of the top-right corner 106 of apparatus 100 shown in FIGS. 1-2. Although only one corner 106 of apparatus 100 is shown in more detail, it will be understood that the explanation provided in connection with FIG. 3 is also applicable to the other three corners of apparatus 100. As shown, the pieces of frame 104 may be configured such that, during assembly of apparatus 100, these pieces are connected at the corners 106 using bolt 302, washer 304 and nut 306. It will be understood that other suitable connection techniques may also be used. For example, a pre-assembled snapping system (not shown) such as currently known in the art may be used in order to form the rectangular frame 104 when assembled. According to various embodiments, where bolting is used such as shown in FIG. 3, the end portions of the pieces of frame 104 which are to be connected at the corners of apparatus 100 include "L" shaped pieces and/or indentions in the material (e.g., cast metal) of frame 104 that serve to strengthen the corner connections and minimize movement once assembly is complete.

FIG. 3 also provides a more detailed view of two of the sleeves 112 of tarp 102. According to various embodiments, as shown in FIG. 3, the material of tarp 104 (or some other material attached thereto) may be sewn onto itself using stitching 308 in such a manner as to create hollow sleeves 112. It is through sleeves 112 that the rigid pieces of frame 104 are pushed during assembly of apparatus 100.

Figure 4A:
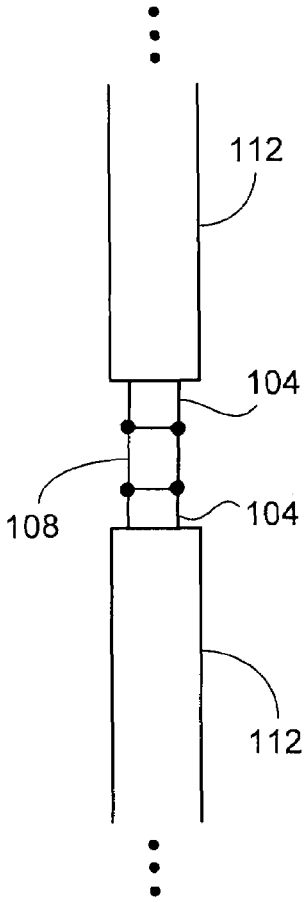
FIGS. 4A, 4B and 4C provide more detailed views of a pivot joint used in the apparatus shown in FIG. 1.
Figure 4B:
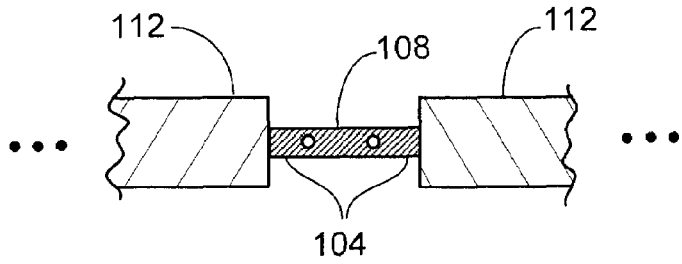
Figure 4C:
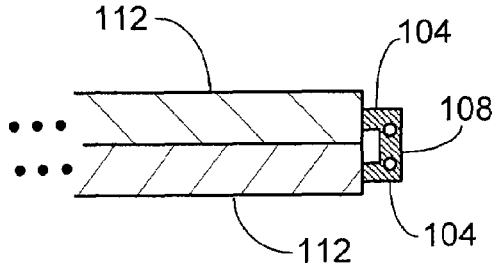

FIGS. 4A, 4B and 4C provide more detailed views of pivot joint 108 of apparatus 100 shown in FIG. 1. It will be understood that pivot joint 110 of apparatus 100, although not shown in similar detail, may be similar or identical to pivot joint 108 shown in FIGS. 4A-4C and discussed below.

FIGS. 4A and 4B respectively show top and side views of pivot joint 108. As shown, pivot joint 108 includes a dual-pivot construction, which allows the two sides of frame 104 extending from pivot joint 108 to rest completely (or at least nearly completely) against each other when apparatus 100 is closed. Thus, such a dual-pivot construction prevents the gap which may otherwise form due to the two sides of frame 104 hitting each other when apparatus 100 is closed (e.g., as would occur if pivot joint 108 was flush with each side of frame 104). It will be understood, however, that the disclosure is not limited to the use dual-pivot joints, and that any other suitable type of joint may be used.

Although pivot joints 108 and 110 are explained above as being situated at respective midpoints of the two longer sides of frame 104, it will be understood that the disclosure is not limited in this manner. That is, pivot joints 108 and 100 may be situated at points other than the midpoints of the two longer sides of frame 104.

A number of embodiments of the disclosure have been described. Nevertheless, it will be understood that various modifications may be made without departing from the spirit and scope of the disclosure. For example, as described above, and according to various embodiments, apparatus 100 is designed to be fully assembled only after purchase by a user, and may be disassembled after such assembly, thus simplifying transportation and sale thereof. Nevertheless, it is contemplated that a user may purchase a fully assembled apparatus 100, and that, according to various embodiments, disassembly may not be intended or possible.

Various other modifications of apparatus 100 described above are contemplated and are within the scope of the disclosure. For example, although handles 114 and 116 of apparatus 100 are shown as attached to the two shorter sides of frame 104, handles 114 and 116 may instead be attached to the two longer sides of frame 104. Moreover, according to various embodiments, only one handle may be used, or more than two handles may be used (e.g., one handle on each of the four sides of frame 104). It is also contemplated that apparatus 100 be configured to have four sides that are equal in length (such that apparatus 100 resembles a square rather than a rectangle), or may be circular in shape or take the shape of a trapezoid, hexagon, or any other suitable shape. It is also noted that, while apparatus 100 has been described above with particular attention to the collection and transportation of leaves from a yard, the disclosure is not limited in this manner. In particular, it will be understood that the disclosure is not limited with respect to the particular item or items being removed, or by the location from which the item or items are being removed from. Moreover, apparatus 100 may also be used for storage of various collected items, such as leaves.

Although the disclosure particularly describes the apparatus and method with reference to certain embodiments thereof, it should be readily apparent to those of ordinary skill in the art that various changes, modifications and substitutes are intended within the form and details thereof, without departing from the spirit and scope of the disclosure. Accordingly, it will be appreciated that, in numerous instances, some features of the disclosure will be employed without a corresponding use of other features. Further, those skilled in the art will understand that variations can be made in the number and arrangement of components illustrated in the above figures. It is intended that the scope of the disclosure include such changes and modifications. Accordingly, other embodiments are within the scope of the disclosure.

The invention claimed is:

1. A folding apparatus comprising:

a frame, having four substantially straight portions that are selectively detachable from one another, a tarp having at least one sleeve extending along edges of the tarp that is adapted to receive the frame; and at least one edge structure connected to the frame or an exterior portion of the tarp, the at least one edge structure being made of a semi-rigid material and being detachably attached to the apparatus;

wherein the at least one sleeve of the tarp at least partially retains a corresponding portion of the frame;

wherein a first portion and a second portion of the frame each include a respective pivot joint permitting the first portion and the second portion to be folded; and wherein the apparatus has an open configuration in which the first portion and the second portion of the frame are substantially straight and the at least one edge structure forms a ramp from the frame or the exterior portion of the tarp to a surface on which the at least one edge structure comes into contact, and a closed configuration in which the first portion and the second portion of the frame are folded using the respective pivot joints such that the tarp forms an enclosure.

2. The apparatus of claim 1, wherein:

a first handle is attached to an edge of the tarp.

3. The apparatus of claim 2, wherein:

the first handle is attached to the tarp at the midpoint of the first portion or the second portion of the frame.

4. The apparatus of claim 3, wherein:

a second handle is attached to the other portion of the frame than the first handle.

5. The apparatus of claim 4, wherein:

the first handle and second handle are joined when the apparatus is in the closed configuration.

6. The apparatus of claim 1, wherein:

a rope is attached at one end to an edge of the tarp and at the other end to a point in the interior of the tarp.

7. The apparatus of claim 6, wherein:

the point in the interior of the tarp is the center point of the tarp.

8. The apparatus of claim 1, wherein:

the at least one edge structure pivots about the frame.

9. The apparatus of claim 1, wherein:

the at least one edge structure connects along the first portion or second portion of the frame.

10. The apparatus of claim 1, wherein:

the frame is rectangular and the corners of the frame are exposed.

11. The apparatus of claim 1, wherein:

the respective pivot joints of the first and second portions of the frame are situated at the respective midpoints of the first and second portions.

12. The apparatus of claim 1, wherein:

the pivot joints are exposed.

13. The apparatus of claim 1, wherein:

the portions of the frame are square shaped.

14. A folding apparatus comprising:

a four-sided frame, having four substantially straight detachable sections, a substantially rectangular tarp having at least one connection along each side of the tarp that is adapted to connect to one of the sides of the frame; and at least one edge structure connected to a portion of the four-sided frame or an exterior portion of the substantially rectangular tarp, the at least one edge structure being made of a semi-rigid material and being detachably attached to the apparatus;

wherein the at least one connection of each side of the tarp connects to a corresponding side of the frame;

wherein a first side and a second side of the frame that are non-adjacent each include a respective pivot joint permitting the first side and the second side to be folded; and wherein the apparatus has an open configuration in which the first side and the second side of the frame are substantially straight and the at least one edge structure forms a ramp from the portion of the four-sided frame or the exterior portion of the substantially rectangular tarp to a surface on which the at least one edge structure comes into contact, and a closed configuration in which the first side and the second side of the frame are folded using the respective pivot joints such that the tarp forms an enclosure.

15. The apparatus of claim 14, wherein:

the four sides of the frame are selectively detachable from one another.

16. The apparatus of claim 14, wherein:

the at least one connection is a sleeve extending along one of the sides of the tarp adapted to receive one of the sides of the frame.

17. A method for making a folding apparatus, comprising:

attaching at least one sleeve adapted to receive a side of a four-sided frame along each side of a four-sided tarp;

dividing a first side and a non-adjacent second side of the frame using a pivot joint permitting the first side and the second side to be folded;

inserting each side of the four-sided frame into a corresponding at least one sleeve adapted to receive a side of the tarp;

connecting each of the sides of the frame in the shape of a four-sided frame; and connecting at least one edge structure to the four-sided frame or the exterior portion of the four-sided tarp, wherein the at least one edge structure is made of a semi-rigid material, and wherein the at least one edge structure is adapted to form a ramp that comes into contact with a surface with the folding apparatus is in an open position.

* * * * *